US011255033B2

(12) United States Patent
Oie et al.

(10) Patent No.: US 11,255,033 B2
(45) Date of Patent: Feb. 22, 2022

(54) PRESSER FOOT VERTICAL DRIVE DEVICE AND SEWING MACHINE INCLUDING THE SAME

(71) Applicant: JANOME SEWING MACHINE CO., LTD., Hachioji (JP)

(72) Inventors: Takeshi Oie, Tokyo (JP); Mizuki Okada, Tokyo (JP); Yukitaka Omata, Tokyo (JP)

(73) Assignee: JANOME CORPORATION, Tokyo (JP)

( * ) Notice: Subject to any disclaimer, the term of this patent is extended or adjusted under 35 U.S.C. 154(b) by 51 days.

(21) Appl. No.: 16/823,689

(22) Filed: Mar. 19, 2020

(65) Prior Publication Data

US 2020/0318272 A1 Oct. 8, 2020

(30) Foreign Application Priority Data

Apr. 5, 2019 (JP) ..... JP2019-072744

(51) Int. Cl.

| | |
|---|---|
| ***D05B 29/02*** | (2006.01) |
| ***D05B 29/06*** | (2006.01) |
| *D05B 55/14* | (2006.01) |
| *D05C 11/06* | (2006.01) |
| *D05B 19/12* | (2006.01) |
| *D05C 9/20* | (2006.01) |

(52) U.S. Cl.

CPC ..... *D05B 29/02* (2013.01); *D05B 29/06* (2013.01); *D05B 19/12* (2013.01); *D05B 55/14* (2013.01); *D05C 9/20* (2013.01); *D05C 11/06* (2013.01)

(58) Field of Classification Search

CPC ..... D05B 29/02; D05B 29/06; D05B 55/14; D05B 19/12; D05C 11/06; D05C 9/20

USPC ..... 112/235–240

See application file for complete search history.

(56) References Cited

U.S. PATENT DOCUMENTS

2016/0215424 A1 7/2016 Ishikawa
2016/0258093 A1 9/2016 Koike et al.

(Continued)

FOREIGN PATENT DOCUMENTS

CN 1676718 A 10/2005
CN 1766192 A 5/2006

(Continued)

OTHER PUBLICATIONS

Office Action dated Jun. 15, 2021, issued in counterpart CN Application No. 202010150858.1, with English Translation. (17 pages).

(Continued)

*Primary Examiner* — Nathan E Durham

(74) *Attorney, Agent, or Firm* — Westerman, Hattori, Daniels & Adrian, LLP

(57) ABSTRACT

A presser foot vertical drive device includes an upper shaft configured to vertically drive a needle, a presser foot drive cam fixed to the upper shaft, a presser foot urged downward over a needle plate, a cam follower configured to be vertically driven in contact with the presser foot drive cam, and a link configured to transmit the vertical drive of the cam follower to the presser foot. The presser foot drive cam includes a plurality of drive cams having cam surfaces for different presser foot vertical drive patterns. The cam follower includes a switching unit for selection of one drive cam from the presser foot drive cam.

18 Claims, 7 Drawing Sheets

(56) References Cited

U.S. PATENT DOCUMENTS

| | | | | |
|---|---|---|---|---|
| 2016/0273144 | A1 | 9/2016 | Koike et al. | |
| 2018/0016722 | A1* | 1/2018 | Ueda | D05B 29/02 |
| 2018/0094371 | A1* | 4/2018 | Kuramashi | D05B 27/06 |

FOREIGN PATENT DOCUMENTS

| | | | |
|---|---|---|---|
| CN | 101168885 | A | 4/2008 |
| CN | 203807740 | U | 9/2014 |
| CN | 205501597 | U | 8/2016 |
| CN | 105986372 | A | 10/2016 |
| EP | 1479809 | B1 | 12/2006 |
| JP | H04-347196 | A | 12/1992 |
| JP | H05-23465 | A | 2/1993 |
| JP | 6-123473 | A | 5/1993 |
| JP | 2006158651 | A | 6/2006 |
| JP | 3953203 | B2 | 8/2007 |
| JP | 2009195514 | A | 9/2009 |
| TW | M401022 | U | 4/2011 |
| TW | 201627550 | A | 8/2016 |
| TW | I585257 | B | 6/2017 |

OTHER PUBLICATIONS

Office Action dated Feb. 2, 2021, issued in counterpart TW Application No. 109108533. (6 pages).

* cited by examiner

PRESSER FOOT VERTICAL DRIVE DEVICE AND SEWING MACHINE INCLUDING THE SAME

BACKGROUND OF THE INVENTION

1. Field of the Invention

The present invention relates to presser foot devices for sewing machines, and particularly to a presser foot vertical drive device for use in an embroidery sewing machine and a sewing machine including such a device.

2. Description of the Related Art

In the related art, a lockstitch sewing machine is known in which, during sewing, a needle having an upper thread inserted therein is passed through the material being sewn (fabric) downward from above, the upper thread is interlocked with a lower thread coming from a bobbin under the fabric to form a stitch, and the needle is then withdrawn upward while the fabric is being urged downward over a needle plate by a presser foot to prevent the fabric from rising.

In particular, in the case of a sewing machine configured to sew an embroidery pattern while moving an embroidery frame having a fabric fixed thereto in the X-Y direction, after a stitch is formed and the needle is withdrawn, it is necessary to move the embroidery frame, i.e., the fabric, to the next stitch position in order to form the next stitch. During this process, the fabric cannot be smoothly moved if the presser foot is urging the fabric downward over the needle plate.

Accordingly, a mechanism is known in which a cam is provided on an upper shaft serving as a drive source for the vertical drive of the needle so that the presser foot is vertically driven by following the cam surface of the cam. This allows the presser foot to be vertically driven together with the vertical drive of the needle, that is, in synchronization with the timing of stitch formation.

Also known is a presser foot height adjustment device, for a sewing machine with an embroidery function, in which the foregoing mechanism is provided with an adjustment knob so that the lowest and highest points of the vertical drive stroke of the presser foot can be vertically adjusted without changing that mechanism (see Japanese Unexamined Patent Application Publication No. 5-123473). This reduces the effect of the fabric on the vertical drive stroke of the presser foot so that good stitches can be formed depending on the fabric thickness, ranging from thick fabrics to thin fabrics.

Furthermore, sewing machines are increasingly being used in various manners, and there is a need to support various sewing and embroidery methods. Examples of such sewing methods include couching embroidery (cord sewing embroidery), in which a cord such as a yarn or a ribbon is sewn to a fabric in addition to upper and lower threads, and ruler work, in which, instead of using automatic feed of a fabric with an embroidery frame, the operator places a ruler on the fabric and sews the fabric while moving the fabric such that the ruler is in contact with the side surface of the presser foot.

However, in couching embroidery, a cord such as a yarn or a ribbon is passed through a needle hole provided in a presser foot to perform embroidery. For the presser foot height adjustment device described in the foregoing patent literature, the cord sewn to the fabric may be caught by the presser foot and may thus hinder the movement of the embroidery frame.

In ruler work sewing, on the other hand, it is necessary that the ruler be in constant contact with the side surface of the presser foot. If the presser foot moves vertically, ruler work may be impossible because the ruler cannot be maintained in contact with the side surface of the presser foot.

SUMMARY OF THE INVENTION

In view of the foregoing problems, an object of the present invention is to provide a presser foot vertical drive device that allows the vertical drive pattern of a presser foot to be changed depending on the embroidery method to flexibly support various sewing and embroidery methods, and also to provide a sewing machine including such a device.

To solve the foregoing problems, the present invention provides a presser foot vertical drive device that employs a configuration including an upper shaft configured to vertically drive a needle, a presser foot drive cam fixed to the upper shaft, a presser foot urged downward over a needle plate, a cam follower configured to be vertically driven in contact with the presser foot drive cam, and a link configured to transmit the vertical drive of the cam follower to the presser foot. The presser foot drive cam includes a plurality of drive cams having cam surfaces for different presser foot vertical drive patterns. The cam follower includes a switching unit for selection of one drive cam from the presser foot drive cam.

In one embodiment, the presser foot vertical drive device according to the present invention employs a configuration which further includes a presser foot lifting and lowering unit configured to move the presser foot upward by moving the link upward and in which the presser foot lifting and lowering unit is configured to separate the cam follower from the presser foot drive cam via the link when moving the presser foot upward. In one embodiment, the presser foot vertical drive device according to the present invention employs a configuration in which the presser foot lifting and lowering unit includes a presser foot lift detection unit configured to detect that the cam follower is separated from the presser foot drive cam and in which the switching unit is configured to allow the presser foot drive cam to be selected based on the detection by the presser foot lift detection unit.

In one specific embodiment, the presser foot vertical drive device according to the present invention employs a configuration in which the switching unit includes a manually operated switching lever. In one specific embodiment, the presser foot vertical drive device according to the present invention employs a configuration in which the switching unit includes a drive motor configured to switch the presser foot drive cam and an operating command unit configured to issue a switching command to the drive motor. The present invention further provides a sewing machine that employs a configuration including the presser foot vertical drive device.

By employing the foregoing configurations, the presser foot vertical drive device according to the present invention allows the vertical drive pattern of the presser foot to be changed by operating the switching unit to flexibly support various sewing and embroidery methods. In addition, the switching unit of the presser foot vertical drive device according to the present invention can not only be configured to be manually operated by the operator, but can also be configured to be automatically operated by the drive motor when the operator simply selects the sewing or embroidery method.

Furthermore, with the presser foot lift detection unit, the presser foot vertical drive device according to the present invention can detect whether or not the switching unit is in a switchable state. For manual operation, it is possible to indicate whether or not switching can be performed. For automatic operation by the drive motor, it is possible to determine whether or not the drive motor may be driven. Thus, the vertical drive pattern of the presser foot can be reliably and safely changed.

BRIEF DESCRIPTION OF THE DRAWINGS

FIG. 4A is a perspective view illustrating the lowered state of the presser lifting lever, and FIG. 4B is a perspective view illustrating the lifted state of the presser lifting lever.

FIG. 5A is a chart plotting the amounts of travel of a needle and the presser foot against the phase of an upper shaft; FIG. 5B is a perspective view illustrating the presser foot at a position $\alpha$ during couching embroidery; FIG. 5C is a perspective view illustrating the presser foot at a position $\beta$ during couching embroidery; and FIG. 5D is a perspective view illustrating the presser foot at a position $\gamma$ during couching embroidery.

DESCRIPTION OF THE PREFERRED EMBODIMENTS

Presser foot vertical drive devices according to embodiments of the present invention will now be described with reference to the drawings shown herein. In the following description, as viewed in the perspective view of FIG. 1, the vertical direction is referred to as "vertical", the direction from the lower left to the upper right is referred to as "lateral", and the direction from the lower right to the upper left is referred to as "forward/rearward". The lateral direction may also be referred to as "X", the forward/rearward direction may also be referred to as "Y", and the vertical direction may also be referred to as "Z".

First Embodiment

Figure 1:
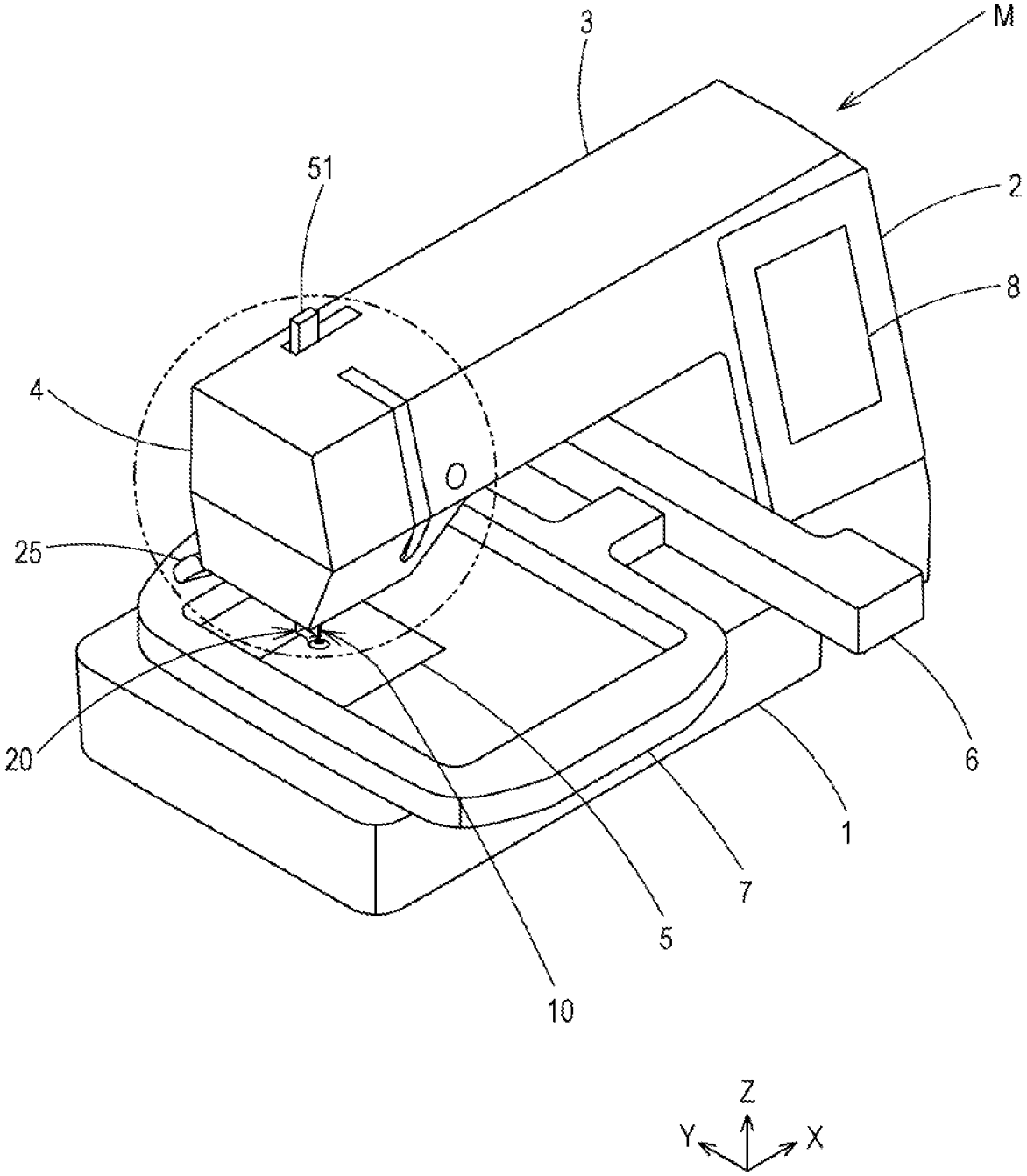
FIG. 1 is a perspective view illustrating the appearance of an embroidery sewing machine according to an embodiment of the present invention.

In FIG. 1, a sewing machine body M includes a bed 1 on the lower side, a post 2 extending upright from the right end of the bed 1, an arm 3 extending leftward from the upper end of the post 2 so as to face the bed 1, and a head 4 projecting from the left end of the arm 3 toward the bed 1 on the lower side.

The bed 1 includes a needle plate 5 disposed on the left side of the upper surface thereof, a carriage 6 disposed on the right side of the upper surface thereof, and an embroidery frame 7 mounted on the carriage 6. The bed 1 also accommodates an embroidery frame drive device 72 (see FIG. 7) configured to move the carriage 6 and the embroidery frame 7 in the X-Y direction.

The post 2 includes a display/operating unit 8 on the front side thereof. The display/operating unit 8 includes a liquid crystal display configured to display, for example, the selected embroidery pattern and various function keys, and a transparent touch panel disposed on the front side of the liquid crystal display for operation of, for example, various function keys displayed thereon. The head 4 includes a needle drive mechanism 10 configured to vertically move a needle 11 from the lower end thereof toward the needle plate 5 on the lower side and a presser foot mechanism 20 configured to urge a fabric downward with a presser foot 21 over the upper surface of the needle plate 5.

Figure 2:
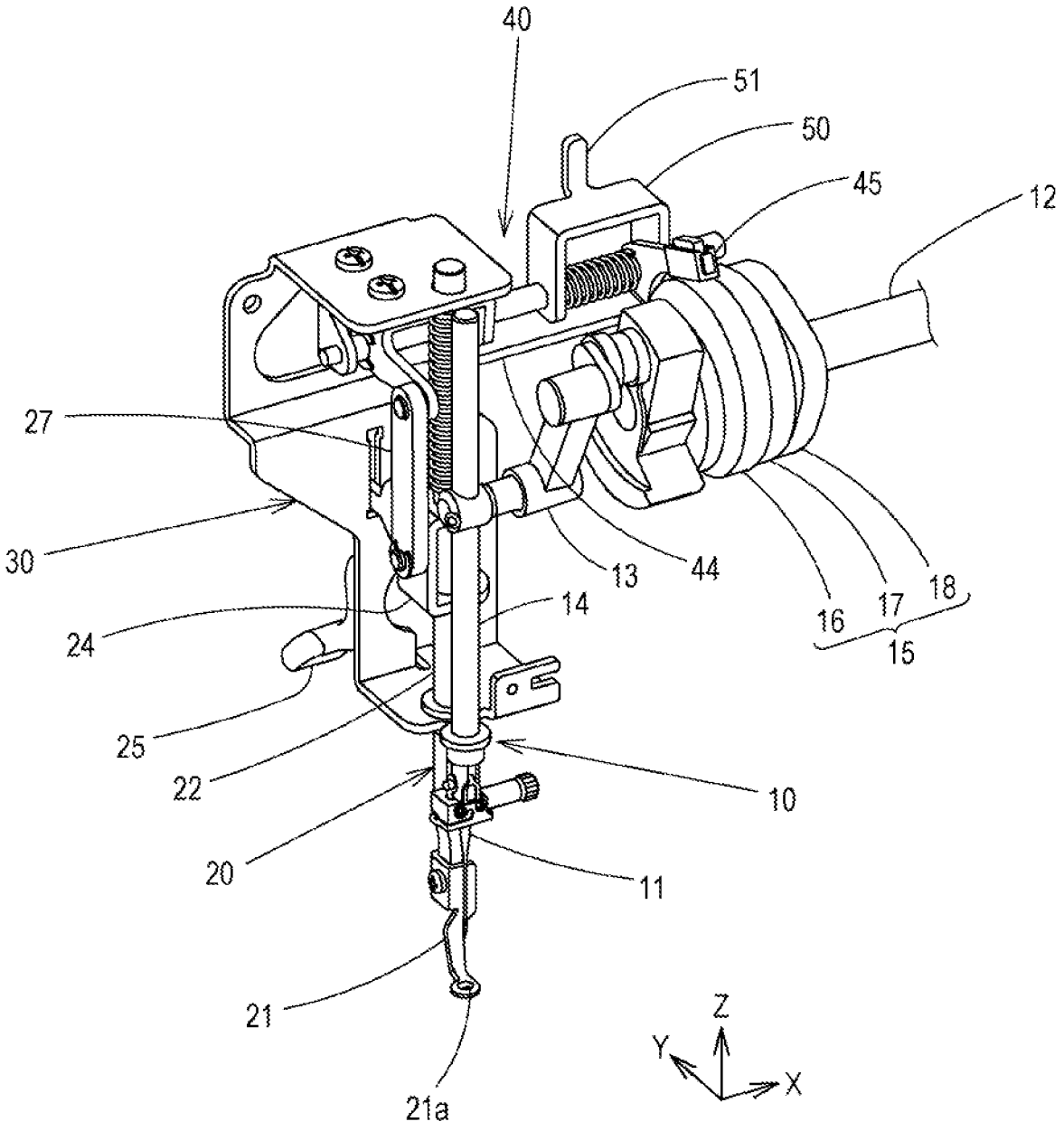
FIG. 2 is a perspective view illustrating a presser foot vertical drive device according to a first embodiment of the present invention.
Figure 3:
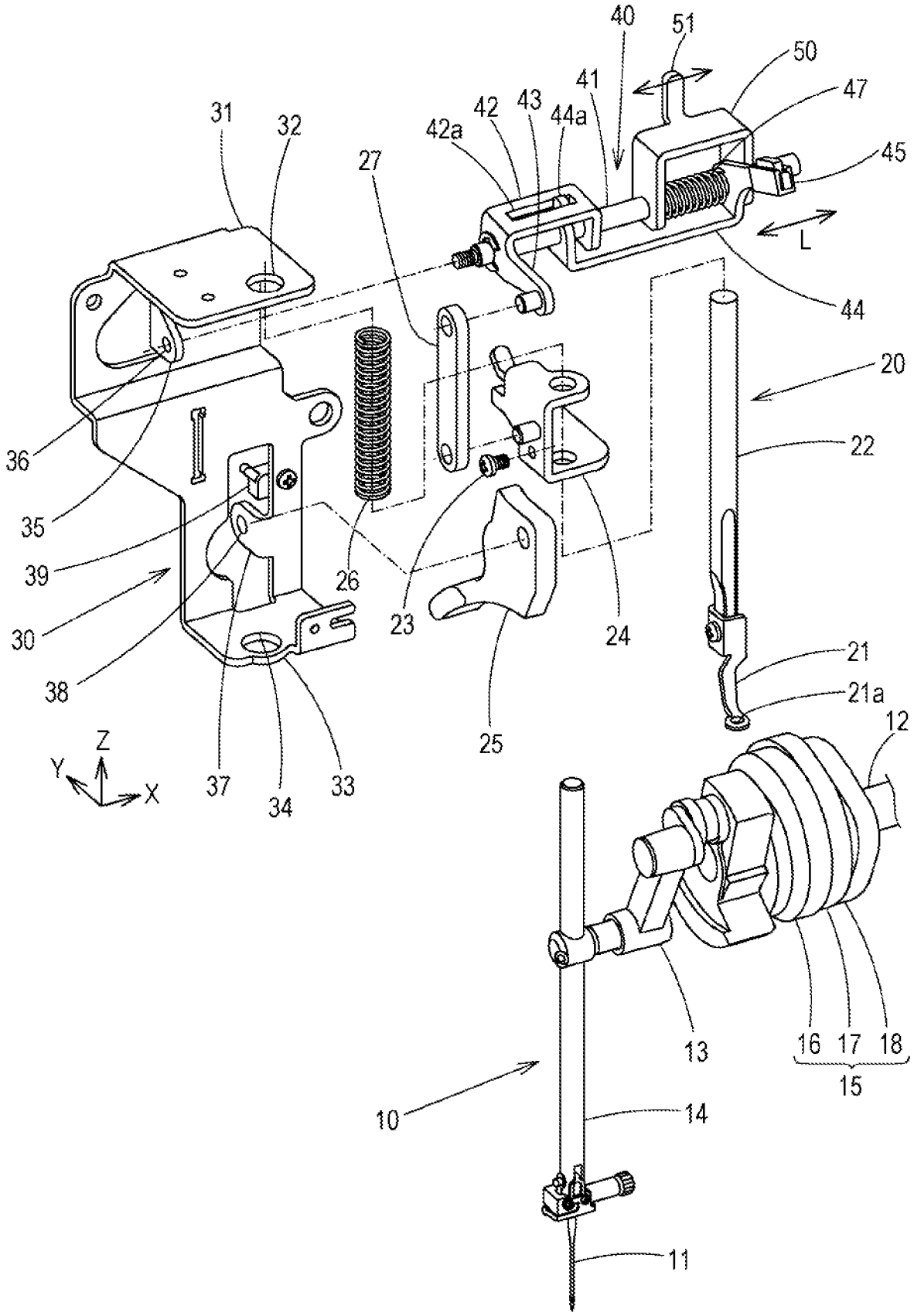
FIG. 3 is an exploded perspective view illustrating the assembly of the presser foot vertical drive device according to the first embodiment of the present invention.

As shown in FIGS. 2 and 3, the needle drive mechanism 10 includes an upper shaft 12 to which the rotational force of a sewing machine motor 71 (see FIG. 7) is transmitted, a crank 13 configured to convert the rotational motion of the upper shaft 12 into a linear reciprocating motion, and a needle bar 14 having the needle 11 attached to the lower end thereof and configured to be vertically reciprocated by the crank 13. The upper shaft 12 has a presser foot drive cam set 15 for a plurality of patterns disposed on the crank 13 side thereof and composed of a first drive cam 16, a second drive cam 17, and a third drive cam 18.

A presser foot mechanism 20 includes a presser bar 22 that has the presser foot 21 attached to the lower end thereof and that is supported by a presser support mechanism 30, described later, so as to be vertically slidable; a presser bar guide bracket 24 fixed to the middle portion of the presser bar 22 with a screw 23; a presser lifting lever 25, serving as a presser foot lifting and lowering unit, that is swingably mounted on the presser support mechanism 30 and that is configured to lift and lower the presser bar 22 in abutment with the presser bar guide bracket 24; a presser spring 26 that has the upper portion of the presser bar 22 inserted therein and that urges the presser bar guide bracket 24 downward by a predetermined pressing force; and a presser link 27 connecting the presser bar guide bracket 24 to a cam follower 40, described later.

The presser bar 22, the presser bar guide bracket 24, and the presser link 27 of the presser foot mechanism 20 function as links configured to transmit the vertical drive of the cam follower 40 to the presser foot 21. In addition, the presser foot 21 has a needle hole 21*a* through which the needle 11 is inserted during sewing.

The presser support mechanism 30 includes, on the upper side thereof, an upper plate 31 having formed therein an insertion hole 32 into which the presser bar 22 is inserted and, on the lower side thereof, a lower plate 33 having formed therein an insertion hole 34 into which the presser bar 22 is inserted. The presser support mechanism 30 holds the presser bar 22 so as to be vertically slidable through the insertion hole 32 and the insertion hole 34. The presser support mechanism 30 also includes an upper mounting portion 35 having formed therein a shaft hole 36 holding an operating shaft 41, described later, of the cam follower 40 below the upper plate 31 and a lower mounting portion 37 having formed therein a mounting hole 38 in which the presser lifting lever 25 is pivotally mounted above the lower plate 33. A presser lift detection sensor 39 serving as a presser foot lift detection unit configured to detect the vertical movement of the presser bar guide bracket 24 is attached near the lower mounting portion 37.

The cam follower 40 includes the operating shaft 41 mounted in the shaft hole 36 of the upper mounting portion 35; a follower frame 42 that is rotatably and unslidably supported on the left side of the operating shaft 41 and that has a lifting arm 43 formed at the left end thereof and having connected thereto the presser link 27 of the presser foot mechanism 20; a follower sliding portion 44 that includes, at the left end thereof, an engaging projection 44*a* engaged in an engaging groove 42*a* formed in the follower frame 42, that is supported so as to be rotatable relative to the operating shaft 41 and to be laterally slidable, and that includes, at the right end thereof, a cam contact portion 45 configured to contact, at the leading end thereof, any cam of the presser foot drive cam set 15; and a switching slider 50 serving as a switching unit configured to slide the follower sliding portion 44 relative to the follower frame 42 in the lateral direction of the operating shaft 41.

As shown in FIG. 1, the switching slider 50 has an operating lever 51 projecting upward from the cover of the arm 3 for manual switching operation by the user. A compression spring 47 is inserted between the left side of the switching slider 50 and the right side of the follower sliding portion 44 so that the switching slider 50 and the follower sliding portion 44 can be slid together relative to the operating shaft 41 in the lateral direction along the operating shaft 41.

Figure 4B:
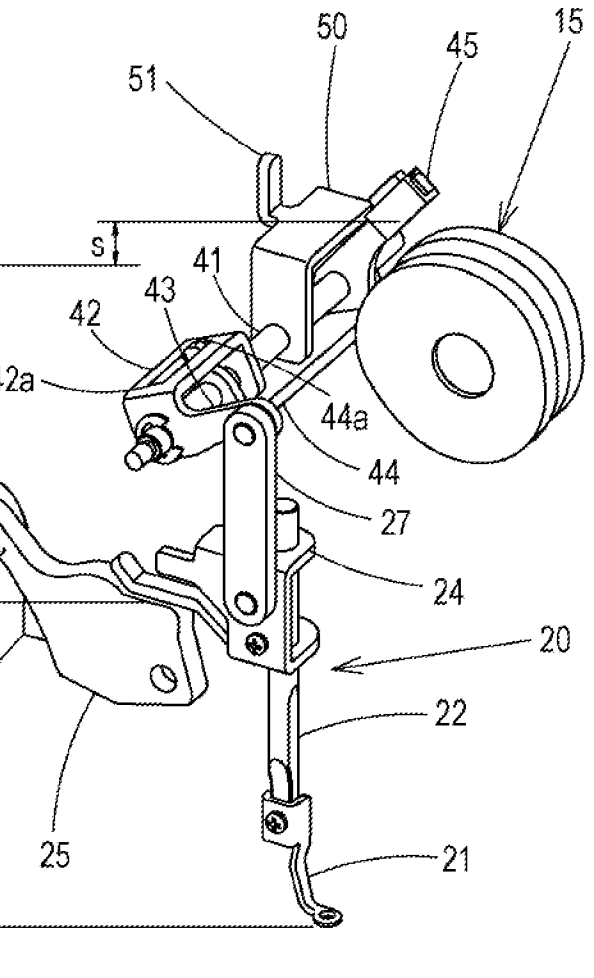
FIGS. 4A and 4B illustrate the state of a presser lifting lever of the presser foot vertical drive device according to the first embodiment of the present invention, where
Figure 4A:
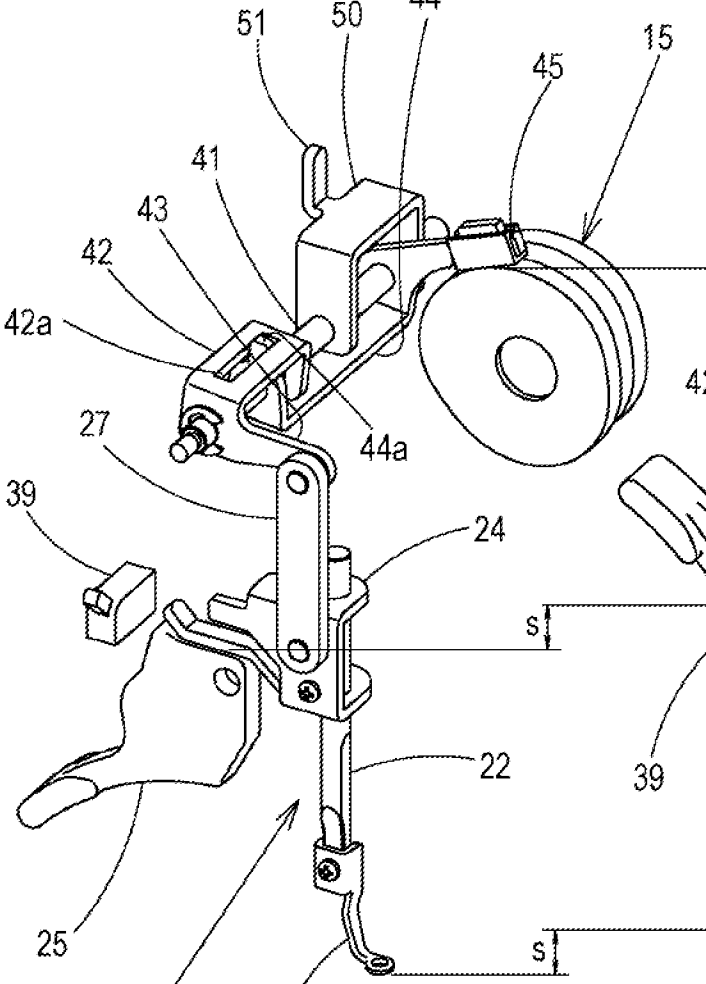

As shown in FIGS. 4A and 4B, when the presser lifting lever 25 of the presser foot mechanism 20 is operated from a lowered state in FIG. 4A to a lifted state in FIG. 4B, a cam surface formed on the upper surface of the presser lifting lever 25 lifts the presser bar guide bracket 24 by a height s. Since the presser bar 22 and the presser foot 21 are fixed to the presser bar guide bracket 24, the presser foot 21 is also lifted by the height s.

On the other hand, since the cam follower 40 is connected to the presser bar guide bracket 24 via the presser link 27, the leading end of the lifting arm 43 of the follower frame 42 is lifted about the operating shaft 41. At the same time, the follower sliding portion 44 is rotated by the engaging projection 44*a* engaged in the engaging groove 42*a* of the follower frame 42. Thus, the leading end of the cam contact portion 45 is lifted upward about the operating shaft 41 by the height s and is separated from the presser foot drive cam set 15.

In the lowered state in FIG. 4A, the presser lifting lever 25 is not in contact with the presser lift detection sensor 39, and the presser lift detection sensor 39 is in an off-state. In the lifted state in FIG. 4B, one of the sidewalls of the presser lifting lever 25 is in contact with the presser lift detection sensor 39, and the presser lift detection sensor 39 is in an on-state. Thus, it is detected that the presser lifting lever 25 is being operated.

Next, the manner of use and advantageous effects of this embodiment will be described.

During sewing using the embroidery sewing machine according to this embodiment, the rotation of the upper shaft 12, to which the rotational force of the sewing machine motor 71 is transmitted, causes the needle 11 to move vertically while causing the presser foot drive cam set 15 fixed to the upper shaft 12 to rotate. In addition, the cam contact portion 45 of the cam follower 40 engages with any cam of the presser foot drive cam set 15 so that the leading end of the cam contact portion 45 swings vertically by following the cam shape of any of the first to third drive cams 16 to 18.

As the leading end of the cam contact portion 45 of the cam follower 40 moves vertically, the follower sliding portion 44 and the follower frame 42 engaged therewith swing about the operating shaft 41, and the leading end of the lifting arm 43 of the follower frame 42 moves vertically. Thus, the presser bar 21 is vertically driven via the presser link 27, the presser bar guide bracket 24, and the presser bar 22, which serve as links.

The cam follower 40, which includes the cam contact portion 45 configured to contact the presser foot drive cam set 15, is connected to the presser foot 21 via the links 22, 24, and 27. When the presser lifting lever 25 is operated to lift the presser foot 21 in preparation for sewing, the cam contact portion 45 is lifted and separated from the presser foot drive cam set 15. Thus, the cam contact portion 45 can be slid in the axial direction of the operating shaft 41 without resistance by the sliding operation of the switching slider 50.

Furthermore, since the presser lift detection sensor 39 configured to detect that the presser lifting lever 25 is lifted is provided, it can be determined whether the cam follower 40 is switchable to any cam of the presser foot drive cam set 15. Thus, it is possible to indicate whether or not switching can be performed between the drive cams 16 to 18 on the display/operating unit 8.

As the presser foot drive cam set 15, a plurality of drive cams 16 to 18 having different cam shapes, namely, the first drive cam 16, the second drive cam 17, and the third drive cam 18, are provided. The cam contact portion 45, which engages with any of the drive cams 16 to 18, can be switched between the drive cams 16 to 18 by operating the operating lever 51 to slide the switching slider 50 laterally so that the cam contact portion 45 contacts any of the drive cams 16 to 18. Thus, the vertical drive pattern of the presser foot mechanism 20 can be changed to support a wide range of sewing conditions and embroidery methods.

Figure 5A:
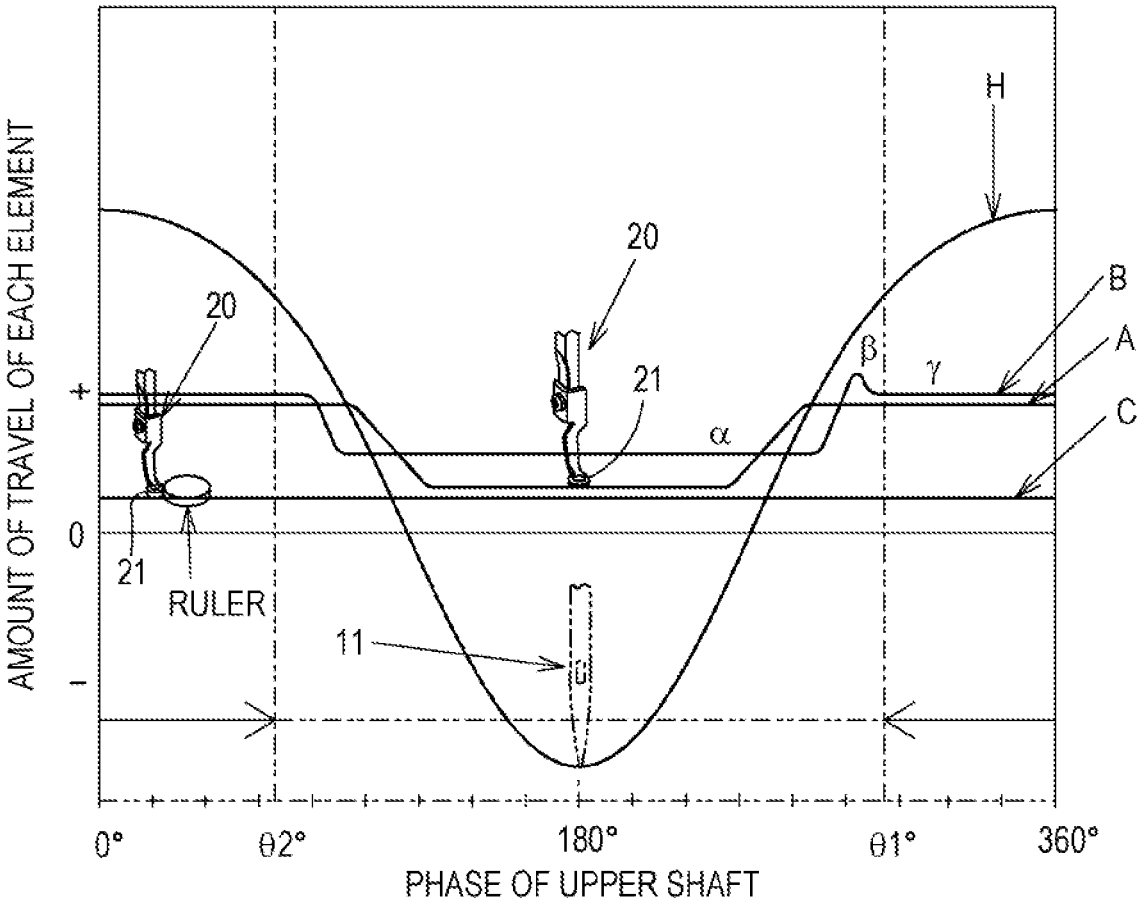
FIGS. 5A to 5D illustrate the state of a presser foot of the presser foot vertical drive device according to the first embodiment of the present invention, where

Next, example vertical drive patterns of the presser foot 21 in combination with the drive cams 16 to 18 that appear when the operating lever 51 is operated to slide the switching slider 50 so that the cam contact portion 45 contacts any of the drive cams 16 to 18 of the presser foot drive cam set 15 will be described with reference to the chart shown in FIG. 5A.

The horizontal axis of the chart indicates the angle of rotation (phase) of the upper shaft 12, that is, the timing in the sewing cycle. The vertical axis of the chart indicates the amount of travel of each element at that timing. The curve A shows the path of the leading end of the presser foot 21 for the first drive cam 16. The curve B shows the path of the leading end of the presser foot 21 for the second drive cam 17. The curve C shows the path of the leading end of the presser foot 21 for the third drive cam 18. The curve H shows a typical path of the leading end of the needle 11.

The pattern A shows the vertical drive pattern of the presser foot 21 for (normal) embroidery using the first drive cam 16. For this vertical drive pattern, the presser foot 21 is vertically driven in synchronization with the vertical movement of the needle 11. In particular, at upper shaft phases from around 180° to around 250°, which correspond to the timing at which the thick portion of the needle 11 is withdrawn from the fabric, the cam surface is set so that the presser foot 21 is located at a low position to prevent the fabric from rising upward, thereby stabilizing embroidery.

After the needle 11 is withdrawn from the fabric, the embroidery frame 7 is driven by the embroidery frame drive device 72 to move the fabric in preparation for the next stitch. To move the fabric without resistance, the cam surface of the first drive cam 16 is set so that the presser foot 21 is positioned upward so as to be separated from the fabric during the driving of the embroidery frame drive device 72 (θ1° to θ2°).

The pattern B shows the vertical drive pattern of the presser foot 21 for couching embroidery (cord sewing embroidery) using the second drive cam 17. In couching embroidery, a cord needs to be sewn to the fabric by embroidery while being inserted through the needle hole 21*a* provided at the lower end of the presser foot 21. For the pattern B, therefore, the cord is present between the fabric and the presser foot 21 at any timing in the sewing cycle. Thus, for this vertical drive pattern, the lowest position of the presser foot 21 is higher than that for the pattern A for normal embroidery using the first drive cam 16 by the thickness of the cord (position α).

In addition, when the needle 11 is lifted, the needle 11 needs to be withdrawn from the fabric and then from the cord. Therefore, it is necessary that the presser foot 21 be not lifted until the needle 11 is withdrawn from the cord, and the timing at which the presser foot 21 is lifted lags slightly behind that for the pattern A.

Figure 5B:
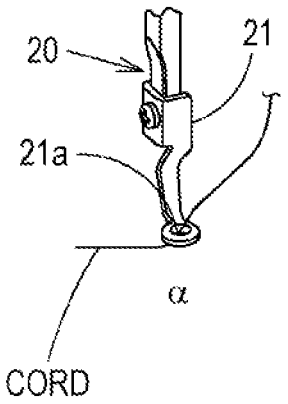
Figure 5C:
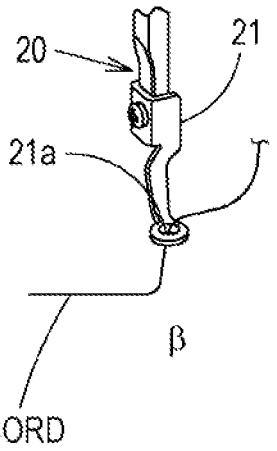
Figure 5D:
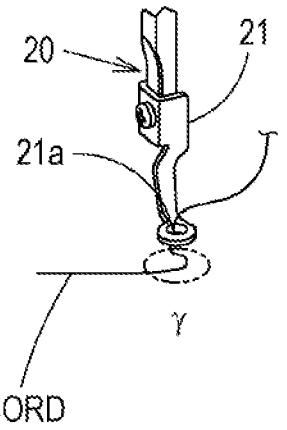

Furthermore, after the needle 11 is withdrawn from the fabric, the embroidery frame 7 is driven by the embroidery frame drive device 72 to move the fabric in preparation for the next stitch. When the fabric is moved, as shown in FIGS. 5B and 5C, the presser foot 21 is lifted to a slightly higher position (position β) and is then slightly lowered (position γ) immediately before the timing at which the embroidery frame drive device 72 is driven (θ1°) so that the fabric can be moved without hindrance by the cord present between the fabric and the needle hole 21*a* of the presser foot 21. Thus, as shown in FIG. 5D, there is a slight sag in the cord present between the fabric and the needle hole 21*a* of the presser foot 21 so that the fabric can be moved without resistance due to tension on the cord during the driving of the embroidery frame 7.

The pattern C shows the vertical drive pattern of the presser foot 21 during ruler work sewing using the third drive cam 18. Ruler work sewing is a method in which the operator places a ruler on a fabric and sews the fabric while moving the fabric such that the ruler is in contact with the side surface of the presser foot 21. Therefore, in ruler work sewing, it is necessary that the ruler be in constant contact with the side surface of the presser foot 21. Accordingly, the amount of lift of the third drive cam 18 is set to be constant irrespective of the angle of rotation of the upper shaft 12 so that the presser foot 21 is not vertically driven.

Whereas the three drive cams 16 to 18 for the first to third patterns are provided as the presser foot drive cam set 15 in the foregoing embodiment, drive cams for four or more patterns may be provided as the presser foot drive cam set 15 as long as a plurality of drive cams are provided and the switching slider 50 can be laterally slid by operating the operating lever 51 to switch the cam contact portion 45 so that the cam contact portion 45 contacts any drive cam.

In addition, the order of the patterns of the presser foot drive cam set 15 is not limited to that of the foregoing embodiment since it is only necessary that the drive patterns can be recognized and used in a switchable manner. Thus, the number and order of the drive patterns and drive cams of the presser foot drive cam set 15 in the present invention are not limited to those of the foregoing embodiment, and the structure of the cam follower 40 including the switching slider 50 and the cam contact portion 45 is not limited to that of the foregoing embodiment.

Second Embodiment

Next, a second embodiment in which the switching of the presser foot drive cam set 15 is mechanically implemented by a drive motor instead of manual operation using the operating lever 51 in the first embodiment will be described with reference to the drawings. In the following description, the same components as those in the first embodiment are denoted by the same reference numerals, and different components are denoted by new reference numerals. Differences will be mainly described.

Figure 6:
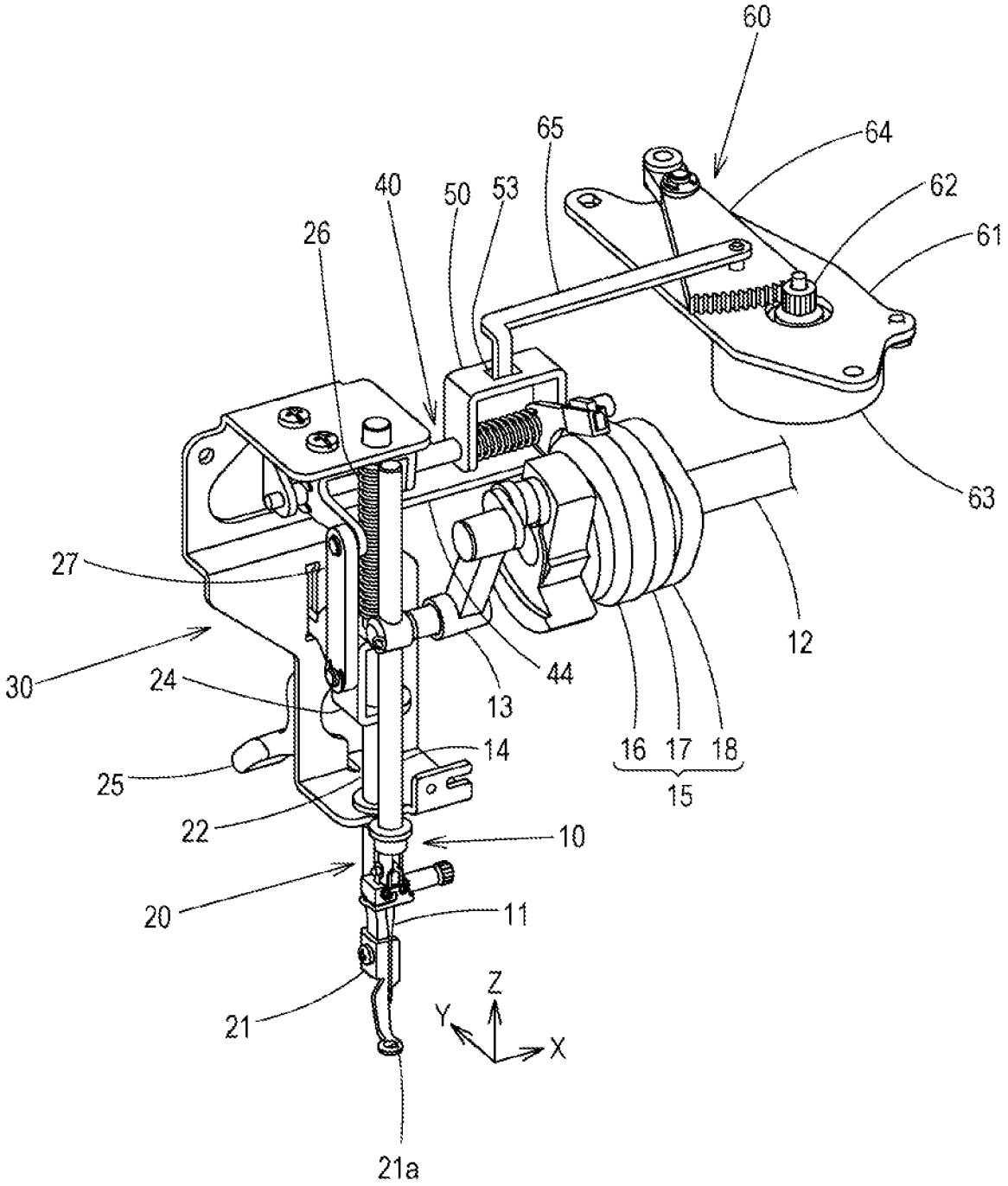
FIG. 6 is a perspective view illustrating a presser foot vertical drive device according to a second embodiment of the present invention.

In FIG. 6, reference numeral 10 denotes a needle drive mechanism configured to vertically move a needle bar 14 having a needle 11 attached to the lower end thereof. Reference numeral 20 denotes a presser foot mechanism configured to urge downward a presser bar 22 having a presser foot 21 attached to the lower end thereof by a predetermined pressing force. Reference numeral 40 denotes a cam follower configured to contact, at a cam contact portion 45 thereof, a cam surface of any cam of a presser foot drive cam set 15 composed of a first drive cam 16, a second drive cam 17, and a third drive cam 18 disposed on an upper shaft 12 and to transmit the vertical drive pattern to the presser foot 21 via the presser bar 22, a presser bar guide bracket 24, and a presser link 27, which serve as links.

Reference numeral 50 denotes a switching slider serving as a switching unit instead of the operating lever 51 for manual operation in the first embodiment. The switching slider 50 has an engaging hole 53 formed on the upper side thereof. Reference numeral 60 denotes a switching drive unit serving as a drive motor. The switching drive unit 60 includes a cam switching motor 63 attached to a motor mounting plate 61 and having a motor gear 62 mounted on an output shaft thereof, a sector gear 64 pivotally mounted on the motor mounting plate 61 and meshing with the motor gear 62, and a switching drive arm 65 pivotally mounted on the sector gear 64 and engaged with the engaging hole 53 of the switching slider 50.

To drive the switching slider 50 so as to slide along the operating shaft 41, the switching drive unit 60 needs to convert the rotational motion of the cam switching motor 63 into a substantially linear reciprocating motion. The conversion into a substantially linear reciprocating motion is achieved by the sector gear 64 meshing with the motor gear 62 and the switching drive arm 65 pivotally mounted on the sector gear 64 and engaged with the engaging hole 53 of the switching slider 50.

Figure 7:
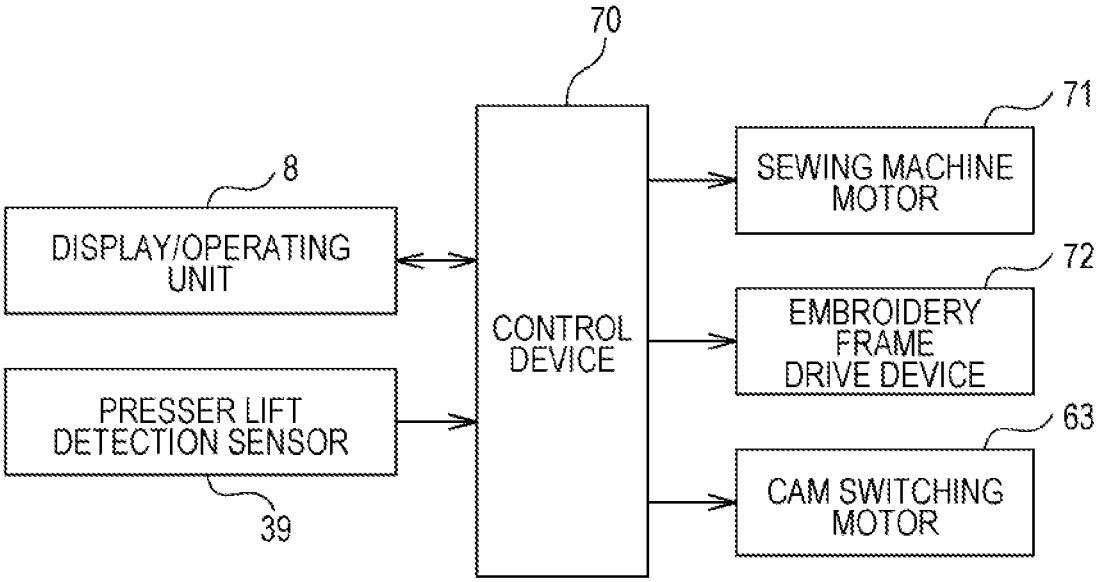
FIG. 7 is a block diagram illustrating the electrical configuration of the presser foot vertical drive device according to the second embodiment of the present invention.

In this embodiment, a control system is configured as shown in the block diagram of FIG. 7. The sewing machine body M includes a control device 70 serving as an operating command unit. The control device 70 has the display/operating unit 8 connected thereto as an input/output, the presser lift detection sensor 39 connected thereto as an input, and the sewing machine motor 71, the embroidery frame drive device 72, and the cam switching motor 63 connected thereto as outputs.

Next, the manner of use and advantageous effects of this embodiment will be described.

During the use of the embroidery sewing machine including the presser foot vertical drive device according to this embodiment, the display/operating unit 8 provided in the post 2 of the sewing machine body M displays embroidery methods (e.g., icons such as those indicating normal embroidery, couching embroidery, and ruler work). The operator touches any icon or the like displayed on the display/operating unit 8 to select the desired embroidery method from those displayed.

In this embodiment, embroidery method information and cam switching information are associated with each other. Thus, based on the embroidery method input via the display/operating unit 8, the control device 70 selects the appropriate drive cam 16, 17, or 18 from the presser foot drive cam set 15 and prepares for a switching command to be output to the cam switching motor 63 in order to switch the cam contact portion 45 of the cam follower 40 to that drive cam 16, 17, or 18.

The control device 70 then determines whether or not the cam contact portion 45 is separated from the presser foot drive cam set 15 so that the cam switching motor 63 can be driven, based on an on-state or off-state signal input from the presser lift detection sensor 39. If the cam switching motor 63 cannot be driven (i.e., if the presser lift detection sensor 39 is in an off-state), the control device 70 suspends the driving of the cam switching motor 63, and the display/operating unit 8 displays the message "Lift the presser lifting lever". In this case, while suspending the driving of the cam switching motor 63, the control device 70 maintains this state until an on-state signal is input from the presser lift detection sensor 39.

When the presser lifting lever 25 is lifted and the presser lift detection sensor 39 inputs an on-state signal to the control device 70, the control device 70 outputs the switching command to the cam switching motor 63. Based on the switching command, the cam switching motor 63 rotates by a predetermined angle to slide the switching slider 50 via the switching drive arm 65. As the switching slider 50 is slid by the rotation of the cam switching motor 63, the cam contact portion 45 slides so as to face any of the drive cams 16 to 18 of the presser foot drive cam set 15. After sliding is completed, the display/operating unit 8 displays the message "Lower the presser lifting lever".

When the presser lifting lever 25 is lowered, the cam contact portion 45 contacts any of the drive cams 16 to 18 of the presser foot drive cam set 15 so that the presser foot 21 can be vertically driven with the vertical movement of the needle 11 in accordance with the pattern of any of the drive cams 16 to 18 during sewing.

In this embodiment, the operator lifts and lowers the presser lifting lever 25 when the cam switching motor 63 is driven to switch between the drive cams 16 to 18. Alternatively, the presser lift detection sensor 39 may detect whether the presser lifting lever 25 is lifted or lowered, and when an embroidery method is newly selected, the presser lifting lever 25 may be automatically lifted and lowered by an electrical drive device such as an electromagnetic solenoid, and the cam switching motor 63 may be driven.

In this embodiment, the switching slider 50 can be slid by the cam switching motor 63, and the switching slider 50 can be automatically switched to any of the drive cams 16 to 18 when the operator simply designates the sewing method on the screen displayed on the display/operating unit 8. Thus, the vertical drive pattern of the presser foot 21 can be optimized when the operator simply selects the desired sewing method, and work is not hindered when the operator forgets to switch between the drive cams 16 to 18.

In particular, if the presser foot 21 and the cam contact portion 45 are lowered when the operator performs a selecting operation, the driving of the cam switching motor 63 may be temporarily suspended, and the display may prompt the operator to lift the presser lifting lever 25 for switching. Thereafter, the cam switching motor 63 can be driven when it is detected that the presser lifting lever 25 is lifted.

The presser foot vertical drive devices according to the embodiments of the present invention allow the vertical drive pattern of the presser foot to be changed by operating the switching unit to flexibly support various sewing and embroidery methods and are particularly advantageous when applied to embroidery sewing machines.

What is claimed is:

1. A presser foot vertical drive device comprising:
- an upper shaft configured to vertically drive a needle;
- a presser foot drive cam fixed to the upper shaft;
- a presser foot urged downward over a needle plate;
- a cam follower configured to be in contact with the presser foot drive cam; and
- a link configured to transmit drive of the cam follower to the presser foot,
- wherein the presser foot drive cam includes a plurality of drive cams having cam surfaces for different presser foot vertical drive patterns, and
- wherein the cam follower includes a cam contact portion configured to be vertically driven and capable of contacting, at a leading end of the cam contact portion, any of the plurality of drive cams, and a switching unit configured to select one of the plurality of drive cams via the cam contact portion.

2. The presser foot vertical drive device according to claim 1, further comprising a presser foot lifting and lowering unit configured to move the presser foot upward by moving the link upward,
- wherein the presser foot lifting and lowering unit is configured to separate the cam follower from the presser foot drive cam via the link when moving the presser foot upward.

3. The presser foot vertical drive device according to claim 2, wherein
- the presser foot lifting and lowering unit includes a presser foot lift detection unit configured to detect that the cam follower is separated from the presser foot drive cam, and
- the switching unit is configured to allow the presser foot drive cam to be selected based on the detection by the presser foot lift detection unit.

4. The presser foot vertical drive device according to claim 3, wherein the switching unit includes a manually operated switching lever.

5. The presser foot vertical drive device according to claim 3, wherein the switching unit includes:
- a drive motor configured to switch the presser foot drive cam; and
- an operating command unit configured to issue a switching command to the drive motor.

6. The presser foot vertical drive device according to claim 2, wherein the switching unit includes a manually operated switching lever.

7. The presser foot vertical drive device according to claim 2, wherein the switching unit includes:
- a drive motor configured to switch the presser foot drive cam; and
- an operating command unit configured to issue a switching command to the drive motor.

8. The presser foot vertical drive device according to claim 1, wherein the switching unit includes a manually operated switching lever.

9. The presser foot vertical drive device according to claim 1, wherein the switching unit includes:

a drive motor configured to switch the presser foot drive cam; and an operating command unit configured to issue a switching command to the drive motor.

10. A sewing machine comprising a presser foot vertical drive device, wherein the presser foot vertical drive device comprises:

an upper shaft configured to vertically drive a needle;

a presser foot drive cam fixed to the upper shaft;

a presser foot urged downward over a needle plate;

a cam follower configured to be in contact with the presser foot drive cam; and a link configured to transmit drive of the cam follower to the presser foot, wherein the presser foot drive cam includes a plurality of drive cams having cam surfaces for different presser foot vertical drive patterns, and wherein the cam follower includes a cam contact portion configured to be vertically driven and capable of contacting, at a leading end of the cam contact portion, any of the plurality of drive cams, and a switching unit configured to select one of the plurality of drive cams via the cam contact portion.

11. The sewing machine according to claim 10, wherein the presser foot vertical drive device further comprises a presser foot lifting and lowering unit configured to move the presser foot upward by moving the link upward, and wherein the presser foot lifting and lowering unit is configured to separate the cam follower from the presser foot drive cam via the link when moving the presser foot upward.

12. The sewing machine according to claim 11, wherein the presser foot lifting and lowering unit includes a presser foot lift detection unit configured to detect that the cam follower is separated from the presser foot drive cam, and wherein the switching unit is configured to allow the presser foot drive cam to be selected based on the detection by the presser foot lift detection unit.

13. The sewing machine according to claim 12, wherein the switching unit includes a manually operated switching lever.

14. The sewing machine according to claim 12, wherein the switching unit includes:

a drive motor configured to switch the presser foot drive cam; and an operating command unit configured to issue a switching command to the drive motor.

15. The sewing machine according to claim 11, wherein the switching unit includes a manually operated switching lever.

16. The sewing machine according to claim 11, wherein the switching unit includes:

a drive motor configured to switch the presser foot drive cam; and an operating command unit configured to issue a switching command to the drive motor.

17. The sewing machine according to claim 10, wherein the switching unit includes a manually operated switching lever.

18. The sewing machine according to claim 10, wherein the switching unit includes:

a drive motor configured to switch the presser foot drive cam; and an operating command unit configured to issue a switching command to the drive motor.

* * * * *